US012054332B2

(12) United States Patent
Shindler et al.

(10) Patent No.: US 12,054,332 B2
(45) Date of Patent: Aug. 6, 2024

(54) MULTI-USE LIQUID CONTAINER AND SMOKING BOTTLE

(71) Applicants: Brandon Shindler, Jacksonville, FL (US); Nathan Shindler, Conroe, TX (US); Pablo E. Bellorin, Conroe, TX (US)

(72) Inventors: Brandon Shindler, Jacksonville, FL (US); Nathan Shindler, Conroe, TX (US); Pablo E. Bellorin, Conroe, TX (US)

( * ) Notice: Subject to any disclaimer, the term of this patent is extended or adjusted under 35 U.S.C. 154(b) by 0 days.

(21) Appl. No.: 17/724,535

(22) Filed: Apr. 20, 2022

(65) Prior Publication Data

US 2022/0332492 A1 Oct. 20, 2022

Related U.S. Application Data

(60) Provisional application No. 63/176,978, filed on Apr. 20, 2021.

(51) Int. Cl.

| | |
|---|---|
| ***B65D 81/36*** | (2006.01) |
| ***A24F 3/00*** | (2006.01) |
| ***B65D 25/20*** | (2006.01) |

(52) U.S. Cl.

CPC ..... *B65D 81/36* (2013.01); *A24F 3/00* (2013.01); *B65D 25/20* (2013.01)

(58) Field of Classification Search

CPC ..... B65D 25/20; B65D 81/36; A24F 3/00
USPC ..... 206/217
See application file for complete search history.

(56) References Cited

U.S. PATENT DOCUMENTS

| | | | | |
|---|---|---|---|---|
| 4,096,868 | A | 6/1978 | Norman | |
| 4,161,954 | A | 7/1979 | Fornaciari | |
| 4,198,993 | A | 4/1980 | Martin et al. | |
| 4,928,412 | A | 5/1990 | Nishiyama | |
| 8,689,802 | B2 | 4/2014 | Schoenfeld | |
| D749,262 | S | 2/2016 | Schoenfeld | |
| 9,788,574 | B2 | 10/2017 | Mullen et al. | |
| 10,427,825 | B2 * | 10/2019 | Buehrle | B65D 1/04 |
| 10,499,687 | B1 * | 12/2019 | Cook | A45F 5/00 |

(Continued)

FOREIGN PATENT DOCUMENTS

WO WO-2019002939 A1 * 1/2019 ..... A24F 1/30

OTHER PUBLICATIONS

BottleBong.JPG (URL: Thebottlebong.com).

(Continued)

*Primary Examiner* — Rafael A Ortiz
(74) *Attorney, Agent, or Firm* — John Rizvi; John Rizvi, P.A.—The Patent Professor®

(57) ABSTRACT

A multi-use liquid container and smoking bottle generally includes a hollow, liquid retaining bottle having a bulb defining an inter chamber for retaining liquids and a hollow first stem extending outwardly from the interior chamber. The multi-use bottle further includes a smoke tube assembly passing through an opening in the liquid retaining bottle and including a hollow secondary stem extending inwardly into the interior chamber, and a bowl connected to and in fluid communication with the secondary stem, the bowl including and at least partially defining a burning chamber. The smoke tube assembly is removable from the liquid retaining bottle. Caps are provided over the first stem and the bowl to prevent liquid contained in the interior chamber from flowing therethrough.

12 Claims, 8 Drawing Sheets

(56) References Cited

U.S. PATENT DOCUMENTS

| | | | | |
|---|---|---|---|---|
| 11,363,838 | B1 * | 6/2022 | Boen | A24F 1/30 |
| 2003/0202343 | A1 * | 10/2003 | Winkler | F21S 13/00 362/174 |
| 2012/0152955 | A1 | 6/2012 | Middleton | |
| 2013/0146070 | A1 | 6/2013 | Ross | |
| 2015/0264976 | A1 | 9/2015 | Benson | |
| 2016/0183590 | A1 | 6/2016 | Bert | |
| 2016/0270439 | A1 | 9/2016 | Webber | |
| 2016/0295911 | A1 * | 10/2016 | Kalousek | A24F 1/30 |
| 2018/0020718 | A1 | 1/2018 | Thoede, Jr. | |
| 2019/0343176 | A1 | 11/2019 | Franklin | |
| 2020/0120976 | A1 | 4/2020 | Liu et al. | |
| 2020/0229491 | A1 | 7/2020 | Williams | |
| 2020/0236992 | A1 * | 7/2020 | Ruiz | A24F 7/04 |
| 2020/0260779 | A1 | 8/2020 | Cecchi et al. | |
| 2020/0367552 | A1 * | 11/2020 | Delgado | A24F 1/30 |
| 2021/0329969 | A1 * | 10/2021 | Burgess | A24F 3/00 |
| 2021/0378295 | A1 * | 12/2021 | Gambino | A24F 1/30 |
| 2021/0401031 | A1 * | 12/2021 | Ou | A24F 1/14 |

OTHER PUBLICATIONS

Goldschlager Water Pipe.JPG.
Tequila Bottle with Smoking Pipe.JPG.
Vodka Bottle that Becomes a Bong Once Finished.JPG.
Woodford Reserve with Smoking Pipe.JPG.

* cited by examiner

MULTI-USE LIQUID CONTAINER AND SMOKING BOTTLE

CROSS-REFERENCE TO RELATED APPLICATIONS

This application claims the benefit of U.S. Provisional Patent Application Ser. No. 63/176,978 filed on Apr. 20, 2021, which is incorporated by reference herein in its entirety.

FIELD OF THE INVENTION

The present invention relates generally to fluid or liquid bottles and smoking devices, and more particularly, to a multi-use liquid container and smoking bottle that can be used as a smoking device after the liquid has been consumed or otherwise removed.

BACKGROUND OF THE INVENTION

Drinking alcoholic beverages is a common pastime often providing pleasure enhancing and relaxation benefits. Alcoholic beverages such as, for example, wine along with hard liquors such as, for example scotches, vodkas, whiskies, brandies and other cordials, and the like are typically sold in bottles which are usually discarded after use. Some alcohol bottles are decorative and are retained after use for display around the home or office.

After drinking the alcoholic beverage, many people like to smoke various combustible substances to aid in further relaxation. Tobacco and, where legal, marijuana are two combustible substances that may provided relaxation benefits in the smoke they provide. Marijuana has been shown to, in addition to provided relaxation benefits, provide medicinal benefits as well and thus has been legalized for use as a medicinal product in some states. Other states have legalized marijuana for recreational use as well.

The smoking of the combustible substances, such as tobacco, is typically accomplished in one of two ways. In a first method, the combustible substance is contained in a combustible housing or covering. For example, tobacco may be deposited on a combustible paper and rolled into a cigarette like shape for ignition and smoking.

In a second method, the combustible material is smoked through the use of a pipe. The pipe typically includes a holder or bowl defining a chamber for holding and burning the combustible material and an elongated, hollow stem in fluid communication with the chamber of the bowl to both draw the smoke generated by the burning material through and give a user a handle or place to hold the pipe. Should a user desire to both drink and smoke a pipe, two items, namely a bottle of liquor and a smoking pipe are needed.

Accordingly, there is need for a solution to at least one of the aforementioned problems. For instance, there is an established need for a multi-use liquor holding and smoking device. There is a further established need for a multi-use liquor holding and smoking device that can be disassembled for ease of cleaning.

SUMMARY OF THE INVENTION

The present invention is directed to a multi-use liquid container and smoking bottle. The multi-use bottle generally includes a hollow, liquid retaining bottle having a bulb defining an inter chamber for retaining liquids and a hollow first stem extending outwardly from the interior chamber.

The multi-use bottle further includes a smoke tube assembly passing through an opening in the bulb and including a hollow secondary stem extending inwardly into the interior chamber and a bowl connected to and in fluid communication with the secondary stem and including defining a burning chamber. The smoke tube assembly is removable from the liquid retaining bottle. Caps are provided over the first stem and bowl to seal in liquid contained in the interior chamber of the bulb.

In a first implementation of the invention, a multi-use liquid container and smoking bottle is provided, the multi-use device comprising: a liquid retaining bottle including hollow bulb defining an interior chamber, having a first opening and a second opening, and a hollow primary stem extending outwardly from said first opening of said hollow bulb and terminating in a open mouth piece, said hollow primary stem defining a primary through bore in fluid communication with said interior chamber of said hollow bulb; and, a smoke tube assembly positioned through said second opening in said hollow bulb, said smoke tube assembly including a secondary stem defining a secondary through bore and extending inwardly into said interior chamber of said hollow bulb and a bowl connected to said secondary stem and positioned outside said hollow bulb, said bowl defining a burning chamber in fluid communication with said secondary through bore of said secondary stem and said interior chamber of said hollow bulb.

In a second aspect, the smoke tube assembly is removably mounted to the hollow bulb of the liquid retaining bottle.

In another aspect, the smoke tube assembly is mounted through a threaded fitting positioned around the second opening in the bulb.

In another aspect, the threaded fitting extends outwardly from an outer surface of the bulb.

In another aspect, the smoke tube assembly includes a second cap, engageable with the threaded fitting, to secure the smoke tube assembly to the bulb.

In another aspect, the threaded fitting includes an end and the bowl includes an enlarged flange, enlarged flange having a diameter greater than the end of the threaded fitting such that the enlarged flange seats against the end of the threaded fitting.

In another aspect, the bulb includes a flat base.

In another aspect, the bulb includes a mouth piece.

In another aspect the first stem has a diameter and the mouth piece has a diameter greater than the diameter of the first stem.

In another aspect, the bulb has a diameter and the mouth piece of the first stem does not extend beyond the diameter of the bulb when the flat base of the liquid retaining bottle is on a level surface.

In another aspect, the first stem is oriented at an angle greater than zero relative to a vertical line extending upwardly along the diameter of the bulb.

In another aspect, the liquid retaining bottle further includes a pad affixed to the flat base to inhibit the liquid retaining bottle from sliding on various surfaces.

In another aspect, the liquid retaining bottle may comprise a decorative external surface.

In another aspect, the liquid retaining bottle may be formed from glass.

In another aspect, the liquid retaining bottle or any portion of the liquid retaining bottle may be formed from ceramic material.

In another aspect, the liquid retaining bottle or any portion of the liquid retaining bottle may be formed from a polymeric material In another aspect, the liquid retaining bottle or any portion of the liquid retaining bottle may be formed from a metallic material.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is generally directed toward a multi-use liquid container and smoking bottle that can be used for smoking various substances after the liquid, such as, by way of example, liquor, has been consumed or otherwise removed from the liquid retaining bottle.

Figure 1:
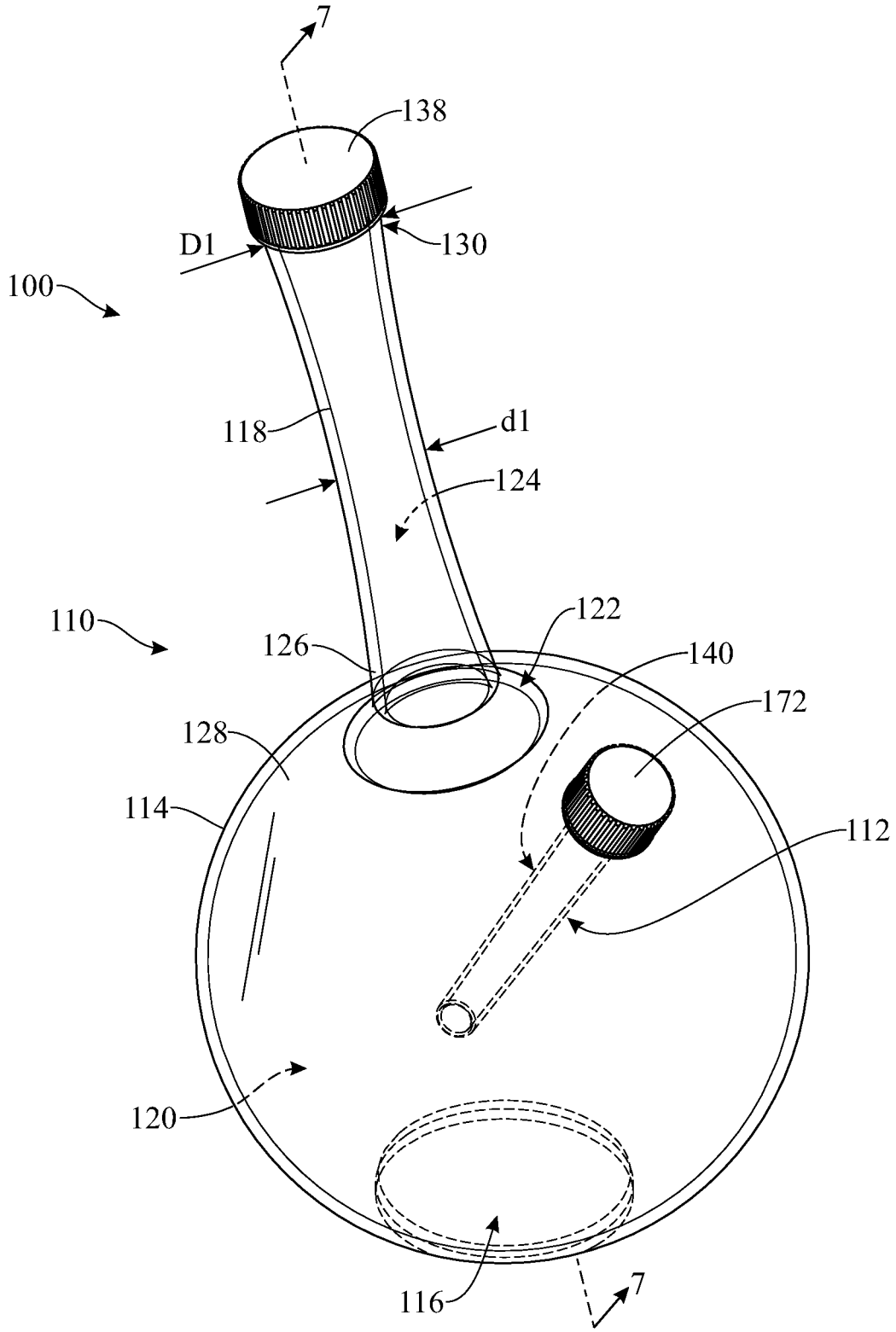
FIG. 1 presents an isometric view of a multi-use liquid container and smoking bottle in accordance with one illustrative embodiment of the present invention.
Figure 2:
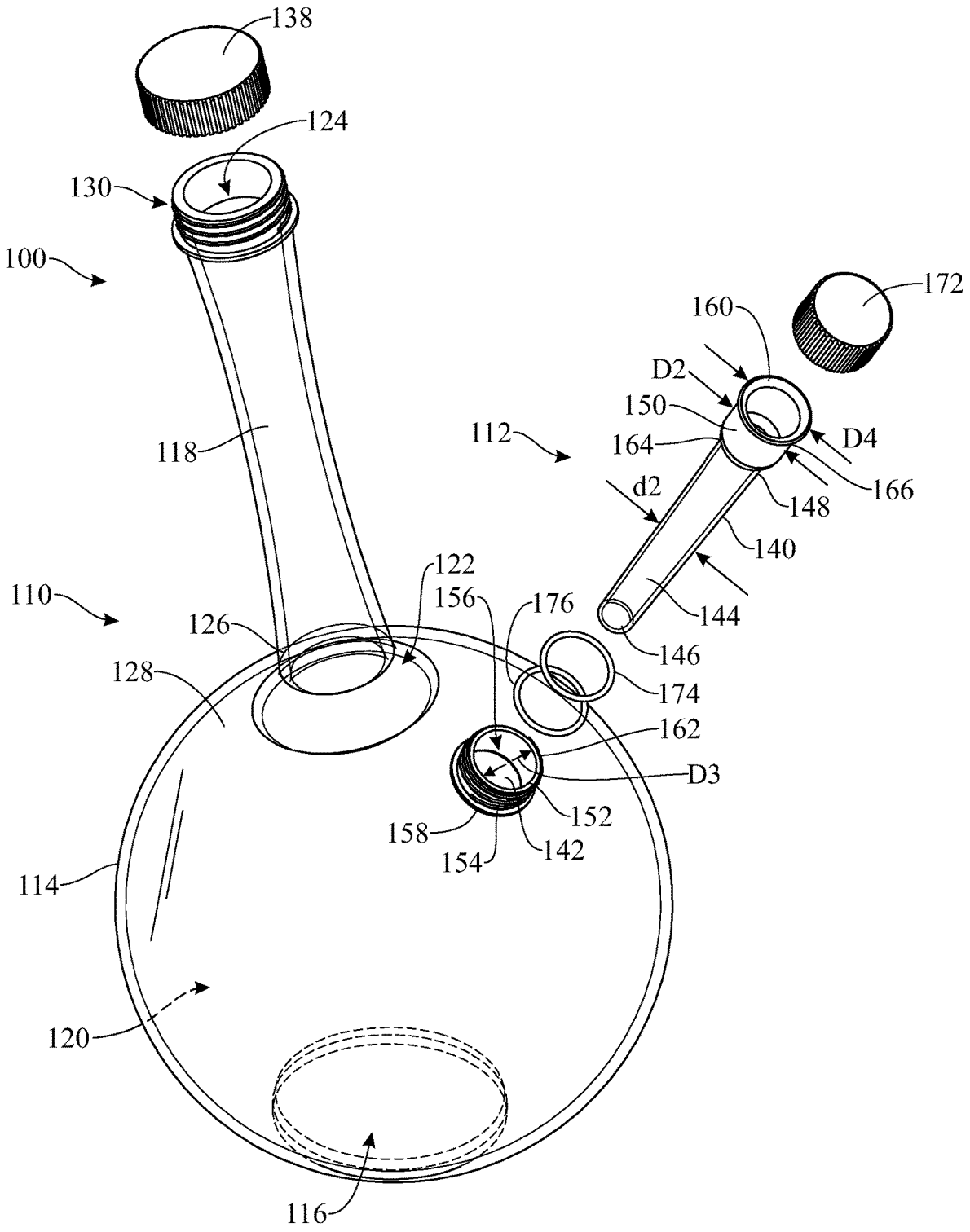
FIG. 2 presents a partially exploded isometric view of the multi-use liquid container and smoking bottle of in FIG. 1.
Figure 3:
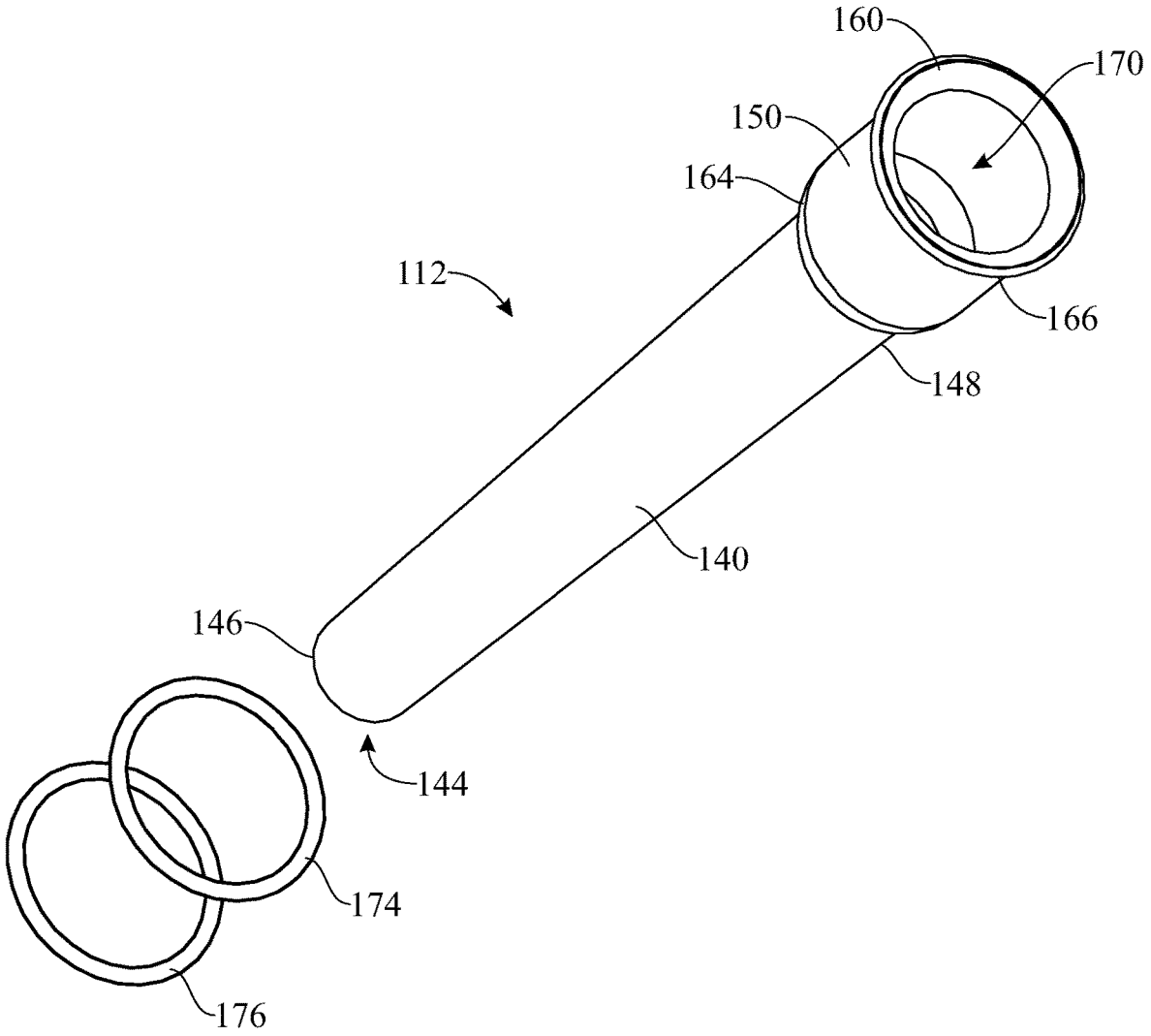
FIG. 3 presents an exploded isometric view of a smoke tube assembly of the multi-use liquid container and smoking bottle of FIG. 2.

Referring to FIGS. 1-7, and initially with regard to FIGS. 1 and 2, a multi-use liquid container and smoking bottle, hereinafter multi-use bottle 100, is illustrated in accordance with an exemplary embodiment of the present invention. As shown, the multi-use bottle 100 generally includes a liquid retaining bottle 110 which at least initially may contain an amount of a liquid, such as, by way of example only, an amount of liquor, and a smoke tube assembly 112 associated with the liquid retaining bottle 110.

The liquid retaining bottle 110 includes a generally spherical, round fluid retaining bowl like structure or bulb 114 having a flat base 116 for stabilizing the bulb 114 when the liquid retaining bottle 110 is resting on a surface and an elongated neck or primary stem 118 extending outward from the bulb 114 as described in more detail hereinbelow. The bulb 114 defines an interior hollow chamber 120 for initially retaining liquids such as, for example, wines, water, various types of liquor's, etc. A first opening 122 is defined through the bulb 114 and is open to the hollow chamber 120. The primary stem 118 defines a hollow primary through bore 124 which is in fluid communication with the hollow chamber 120 of the bulb 114 through the first opening 122. Specifically, a first end 126 of the primary stem 118 extends outward from an outer surface 128 of the bulb 114. The primary stem 118 may be attached to the outer surface 128 of the bulb 114 by various means such as, for example, gluing, melting, fusing, etc. In a preferred embodiment, the primary stem 118 is formed integrally with the bulb 114.

An enlarged second end or mouthpiece 130 of the primary stem 118 is open to the primary through bore 124 of the primary stem 118 to allow a user to drink a liquid contained in the liquid retaining bottle 110 and to allow the user to position their mouth over the open mouthpiece 130 in order to draw in smoke created by the smoke tube assembly 112 discussed hereinbelow. The diameter "D1" of the mouthpiece 130 is greater than the diameter "d1" of the primary stem 118 to allow a user to get their lips into the mouthpiece to draw out liquid or smoke as noted hereinbelow. A first or primary bottle cap 138 is provided over the mouthpiece 130 to seal the liquid retaining bottle 110 prior to use. The bottle cap 138 may be threaded onto the mouthpiece 130 or otherwise secured to the mouthpiece 130.

As noted hereinabove, the multi-use bottle 100 includes the smoke tube assembly 112 to allow a user to smoke various materials through the liquid retaining bottle 110 after the liquid retaining bottle 110 has been emptied of its initial liquid contents. In at least one embodiment, the liquid retaining bottle 110 may be partially re-filled with water or another liquid prior to use as a smoking device. Thus, the smoke tube assembly 112 generally includes a smoke tube or secondary stem 140 which extends inwardly into the chamber 120 of the bulb 114 through a second opening 142 in the bulb 114. Specifically, the secondary stem 140 defines a hollow secondary through bore 144 which is in fluid communication with the chamber 120 of the bulb 114. The secondary stem 140 includes an open first end 146 located or positioned inside the chamber 120 and a second end 148 which engages the bulb 114. As best shown in FIG. 2, the second end 148 of the secondary stem 140 includes a receptacle or bowl 150 for receipt of material to be burned to generate smoke, or to receive any common size bowl.

With continued reference to FIG. 2, a hollow threaded fitting 152 having exterior threads 154 and at least partially defining a through bore 156 extends outwardly from the outer surface 128 of the bulb 114. The secondary stem 140 is removably insertable through the through bore 156 in the bulb 114 to position the secondary stem 140 of the smoke tube assembly 112 within the bulb 114. The bowl 150 of the smoke tube assembly 112 has a diameter "D2" which is larger than the diameter "d2" of the secondary stem 140. The diameter D2 of the bowl 150 is slightly smaller than the inner diameter "D3" of the through bore 156 of the threaded fitting to allow the bowl 150 to be seated within the threaded fitting 152. The hollow threaded fitting 152 has a first end 158 connected to and extending outwardly from the outer surface 128 of the bulb 114.

The bowl 150 of the smoke tube assembly 112 has an enlarged flange 160 which engages a second end 162 of the hollow threaded fitting 152 to prevent the smoke tube assembly 112 from passing through and into the chamber 120 of the bulb 114. Specifically, with respect to FIG. 3, the bowl 150 includes a first end 164 attached to the second end 148 of the secondary stem 140 and a second end 166 terminating in the enlarged flange 160. Specifically, the enlarged flange 160 prevents the smoke tube assembly 112 from passing through and into the chamber 120 of the bulb 114 of the present multi-use bottle 100. The bowl 150 defines a bowl or burning chamber 170 which is in fluid communication with the secondary through bore 144 of the secondary stem 140 and thus the chamber 120 of the bulb 114, as shown best in FIG. 3.

When the secondary stem 140 is fully inserted through the through bore 156 of the threaded fitting 152, the enlarged flange 160 of the bowl 150 rests against the second end 162 of the threaded fitting 152. The enlarged flange 160 has a diameter "D4" which is greater than the inner diameter D3 of the threaded fitting 152 and thus cannot pass through the through bore 156 of the threaded fitting 152.

In order to secure the smoke tube assembly 112 to the liquid retaining bottle 110 prior to use, the smoke tube assembly 112 includes a second or bowl cap 172 which has internal threads (not shown) which engage the threads 154 of the threaded fitting 152. Screwing the second cap 172 onto the threaded fitting 152 secures the smoke tube assembly 112 to the bulb 120 of the liquid retaining bottle 110, as shown best in FIG. 1, and prevents any liquid contained therein from escaping. A pair of O-rings 174 and 176 may be provided to aid in sealing smoke tube assembly 112 to the bulb 114. One or more O-rings 174 and 176 may be positioned at the first end 158 of the threaded fitting 152 to further seal the connection with the second cap 172. Alternatively, the O-rings 174 and 176 may be positioned between the second end 162 of the threaded fitting 152 and the flange 160 of the bowl 150 to seal the bowl 150 against the threaded fitting 152.

The bulb 114, primary stem 118, secondary stem 140 and bowl 150 of the multi-use bottle 100, along with the first cap 138 and the second cap 172, may be formed from a variety of materials such as, by way of example only, glass, PYREX®, porcelains, ceramics, plastics, acrylics, crystal or quartz, metallic materials, such as titanium or stainless steel, etc. In at least one embodiment, the secondary stem 140 and/or O-rings 174 and 176 may be formed from medical grade silicone, food grade silicone, rubber and the like. The outer surface 128 of the bulb 114 of the liquid retaining bottle 110 provides a place for artwork, indicia, logos, directions and warnings, etc.

Figure 4:
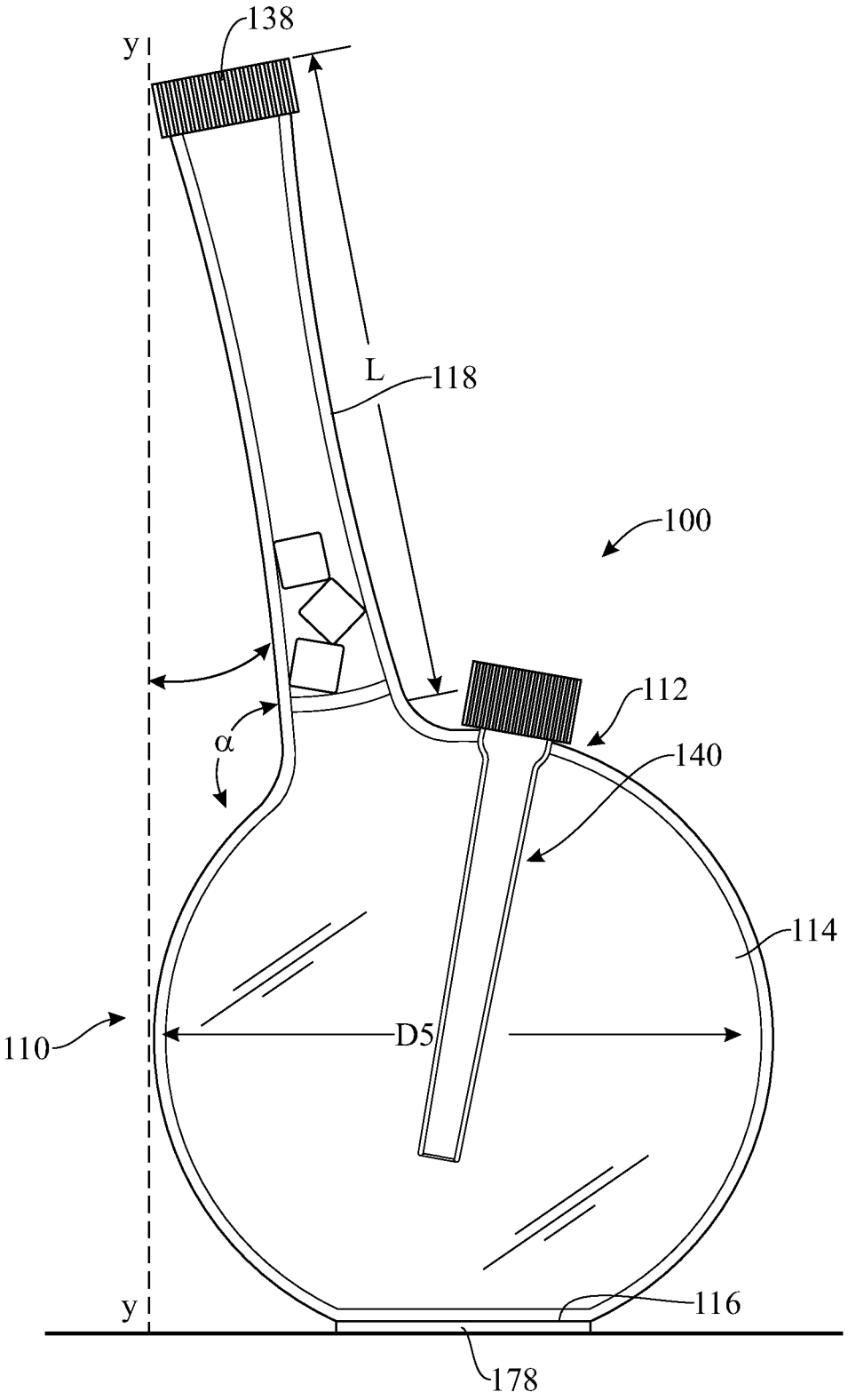
FIG. 4 presents a side elevation of the multi-use liquid container and smoking bottle of FIG. 1.

Referring for the moment to FIG. 4, the present multi-use bottle 100 is configured for ease of display and convenient staging of a plurality of multi-use bottles 100 on a display shelf. The bulb 114 has an outer diameter "D5". The primary stem 118 is angled relative to the bulb 114 at an angle $\alpha$. The angle $\alpha$ is such that the primary stem 118 and/or the bottle cap 138 does not pass beyond a vertical line y-y extending upwardly along the outer diameter D5 of the bulb 114. This allow the multi-use bottle 100 to be positioned as closely as possible to a wall or another multi-use bottle 100. Thus, the outer cap 138 or the mouthpiece 120 does not pass beyond the outer diameter D5 of the bulb 114. The amount of the angle $\alpha$ will depend on and is relative to the overall diameter D5 of the bulb 114 and the length "L" of the primary stem 118. It should be noted that, the multi-use bottle 100 and more particularly the bulb 114 may include a padded or slip resistant pad 178 attached to the flat base 116 of the bulb 114 to prevent the multi-use bottle 100 from sliding off of a surface, such as a shelf or table.

Referring now to FIGS. 1 and 5-7, the use of the multi-use bottle 100 will now be described. The multi-use bottle 100 is intended to be initially filled with a liquid such as, for example, wine, liquors or other hard spirits or other liquid 300. As shown in FIG. 1, initially, the first cap 138, covering and sealing the primary stem 118, and the second cap 172, sealing the smoke tube assembly 120, are affixed to seal the multi-use bottle 100 to prevent spillage of the liquid 300 contained therein. The flat base 116 and the angle $\alpha$ between the primary stem 118 and the bulb 114 allows the multi-use bottle 100 to be safely and compactly stored with other multi-use bottles 100 on a shelf or table.

Figure 5:
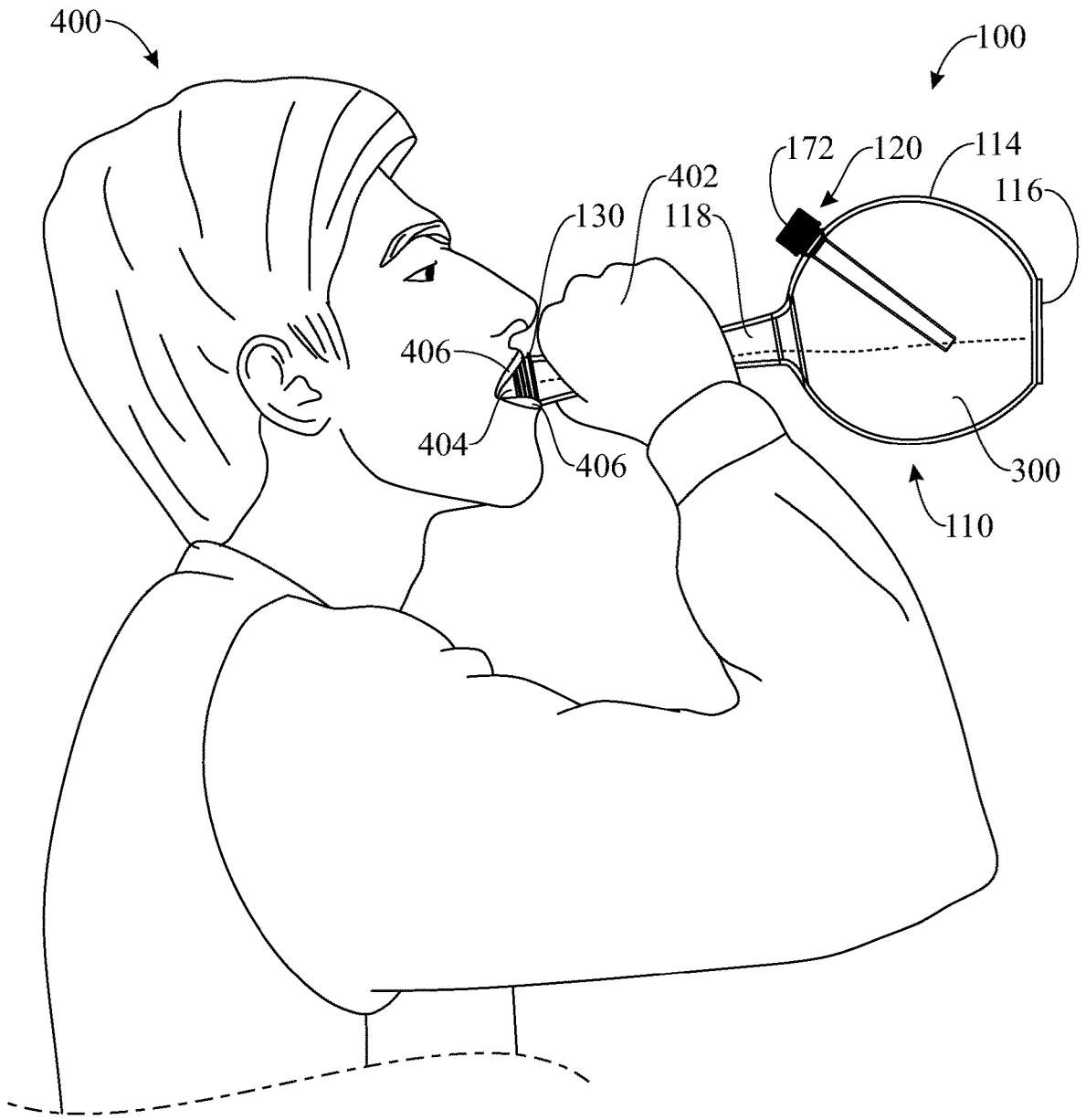
FIG. 5 presents an isometric view of the multi-use liquid container and smoking bottle of FIG. 1 partially filled with liquid and with a neck cap removed to allow access to the liquid by a user.

Referring to FIG. 5, once a user such as, for example user 400 has acquired the liquid containing multi-use bottle 100, the first cap 138 can be removed and the multi-use bottle 100 grasped by the bulb 114 or, as shown in FIG. 5, by the primary stem 118 by the user's hand 402. The user 400 then places his or her mouth 404 and lips 406 over the mouthpiece 130 and tilts the multi-use bottle 100 back to allow the liquid 300 to flow through the primary stem 118 and into the user's mouth 404 to drink the liquid 300. The user can also grasp the liquid retaining bottle 110 by the bulb 114 or the primary stem 118 with his or her hand 402 and tilt the multi-use bottle 100 above a container (not shown) such as a cup or glass to allow the liquid 300 to flow through the primary stem 118 an into such container. It should be noted that the smoke tube assembly 120 can provide a venting function by slightly unscrewing the second cap 172 from the secondary stem 140 to allow a slight amount of air to flow into the chamber 120 of the bulb 114 thereby allowing a smoother flow of liquid 300 into the user's mouth 404 or receptacle.

Once all the liquid 300 has either been consumed or otherwise emptied from the multi-use bottle 100, the multi-use bottle 100 can then be used to smoke various substances. In preparation for smoking, it is desirable to rinse out the multi-use bottle 100 with water (not shown) to clean out any remaining liquids and any volatile, and thus potentially dangerous and flammable residue that may be left behind by alcoholic beverages. After the multi-use bottle 100 has been rinsed out, it can be prepared for use as a smoking device.

Figure 6:
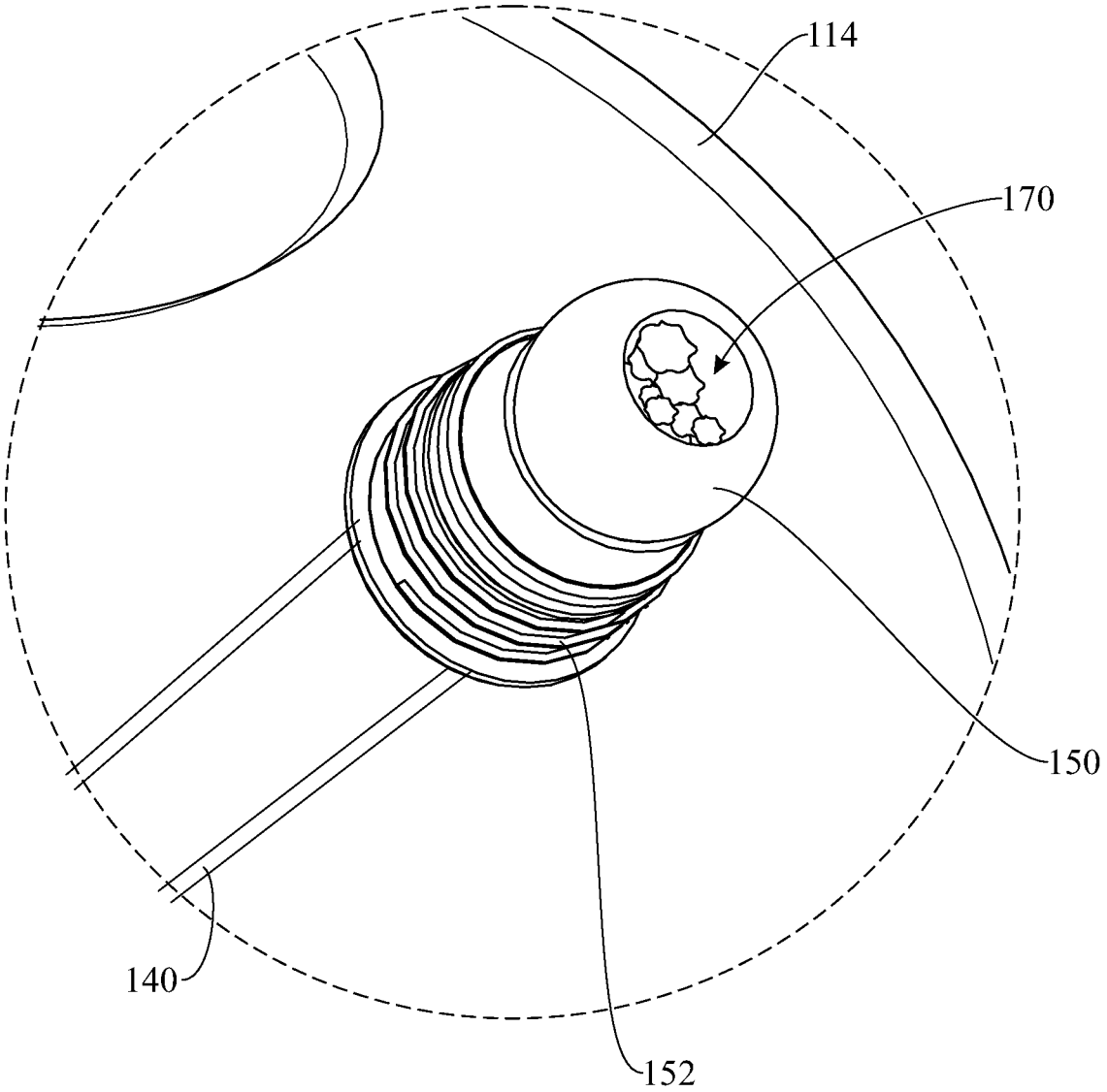
FIG. 6 presents an isometric view of the smoke tube assembly of the multi-use liquid and smoking bottle of FIG. 1 with smoke generating material positioned in a first end of the smoke tube assembly.

Referring to FIGS. 2 and 6, to "load" or otherwise prepare the multi-use bottle 100 for the smoking function, the second cap 172 is initially unscrewed or otherwise removed from the threaded fitting 152 on the bulb 114, as shown in FIG. 2. This can be done while rinsing out the multi-use bottle 100 to allow complete removal of the smoke tube assembly 112 to facilitate rinsing or otherwise cleaning out the bulb 113 and primary stem 118. The smoke tube assembly 112 can be completely removed to clean out any residue either from the liquid 300 or subsequent smoking use.

Removing the second cap 172 uncovers the bowl 150 of the smoke tube assembly 112 for use. A combustible and smoke generating medicinal or recreational material such as, for example, tobacco or other smokable substance 500 is inserted into the burning chamber 170 of the bowl 150 and compacted or otherwise positioned in the burning chamber 170 for subsequent ignition, as shown in FIG. 6.

Figure 7:
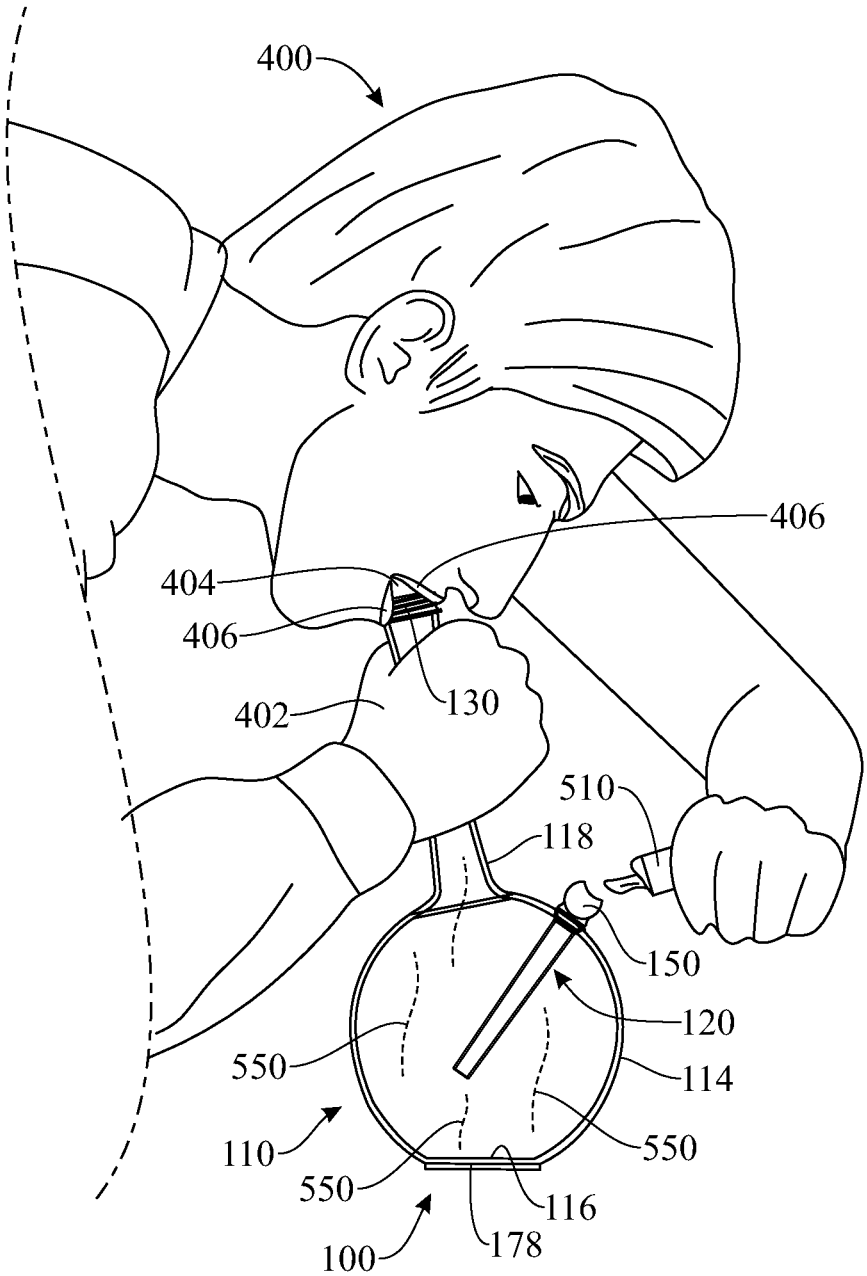
FIG. 7 presents an isometric view of a user igniting the smoke generating material positioned in the smoke tube assembly of the disclosed multi-use liquid container and smoking bottle of FIG. 6 to generate smoke within a bowl of the multi-use liquid container and smoking bottle and inhaling the generated smoke through a neck of the multi-use liquid container and smoking bottle.

Referring now to FIG. 7, in order to smoke the tobacco or other smokable substance 500 in the bowl 150 of the multi-use bottle 100, the user positions the lips 406 over the mouthpiece 130 of the primary stem 118 or positions the lips 406 in the mouthpiece 130. A match or lighter 510 is then used to ignite the tobacco 500. Once lit, the user can draw in air through the primary stem 118 to draw smoke 550 generated by the burning tobacco 500 into the chamber 120 of the bulb 114. Continued inhalation draws the smoke 550 up through the primary stem 118 and into the user's 400 mouth 404.

Figure 8:
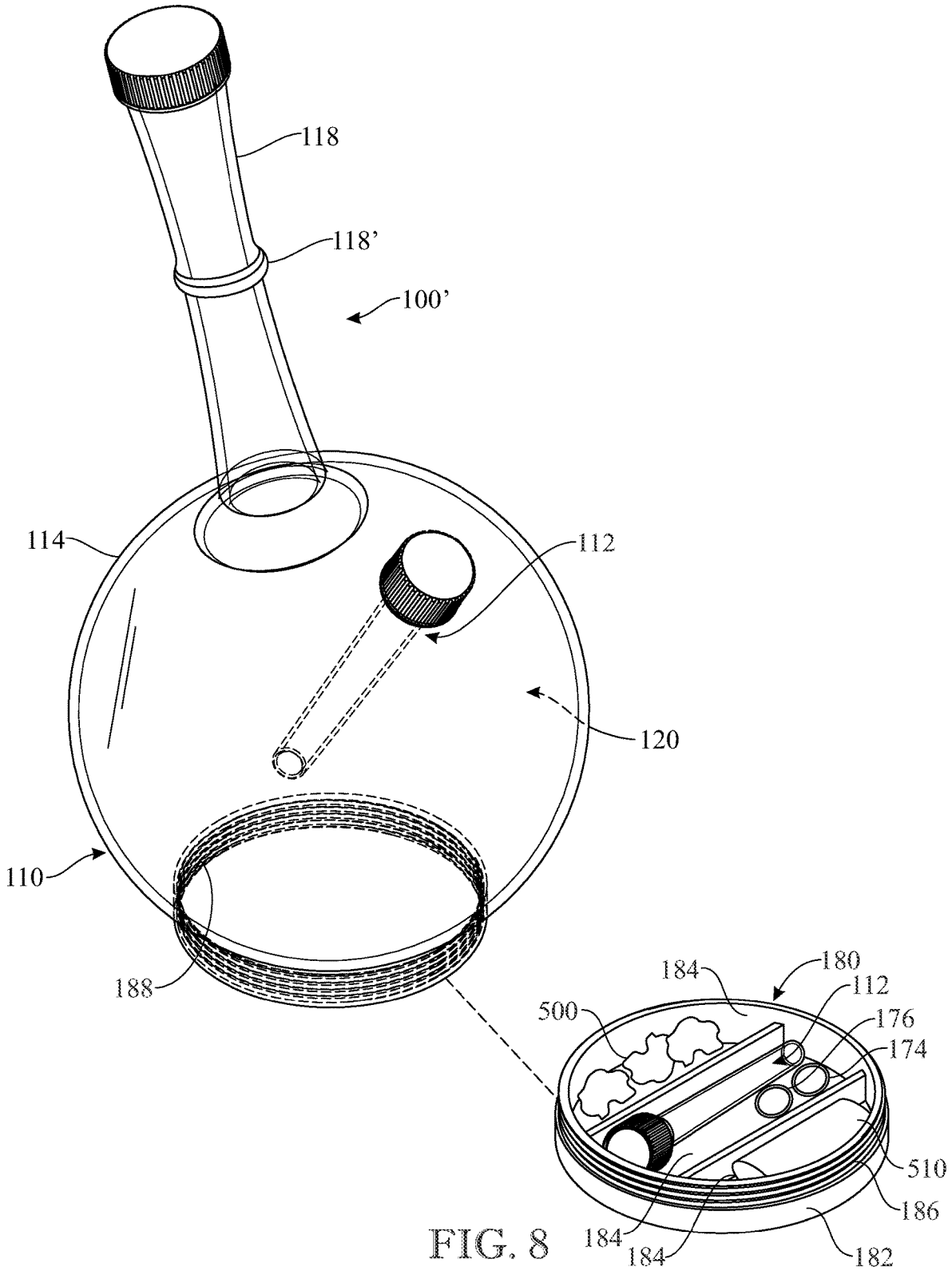
FIG. 8 presents an isometric view of a multi-use liquid container and smoking bottle having a storage assembly, in accordance with one alternate illustrative embodiment of the present invention.

With reference to FIG. 8, presented therein is an isometric view of one alternate illustrative embodiment of a multi-use liquid container and smoking bottle 100' including a storage assembly 180, in accordance with the present invention. As before, the multi-use liquid container and smoking bottle 100' includes a liquid retaining bottle 110 for at least initially containing an amount of a liquid, such as an alcoholic beverage including liquor, wine, etc. Also as before, the liquid retaining bottle 110 includes a bowl or bulb 114 which at least partially defines a hollow inner chamber 120 in which an amount of liquid may be contained.

With continued reference to FIG. 8, a smoke tube assembly 112 is at least partially positionable into the chamber 120 of the liquid retaining bottle 110. As noted hereinabove, the smoke tube assembly 112 is removable from the bulb 114 to facilitate cleaning before and after use. Thus, the present multi-use bottle 100, 100' can be used to contain and dispense a liquid, and subsequently, it may be used to smoke a recreational or medicinal substance. An elongated neck or primary stem 118 is interconnected to and extends upwardly and slightly outwardly from the liquid retaining bottle 110 to facilitate drinking or smoking therefrom, in the manner disclosed and described hereinabove. As further shown in FIG. 8, in at least one embodiment, a multi-use liquid container and smoking bottle 100' includes a finger stop 118' disposed at least partially around a portion of the primary stem 118 to facilitate gripping and maneuvering of the multi-use bottle 100' by a user.

As noted above, the alternate embodiment of a multi-use liquid container and smoking bottle 100' includes a storage assembly 180 mounted thereto. Looking further to FIG. 8, a storage assembly 180 includes a storage unit 182 which includes at least one storage chamber 184 in which a variety of items may be stored. In at least one embodiment, a storage unit 182 is attachable proximate the bottom of the liquid retaining bottle 110 and, as such, includes a flat base (not shown), similar to flat base 116 described and disclosed hereinabove, so as to stabilize the multi-use bottle 100' while stored on a shelf or staged on a tabletop for use.

As may be seen from FIG. 8, in at least one embodiment, a storage unit 182 includes a plurality of storage chambers 184. The smoke tube assembly 112 and/or O-rings 174, 176 may be stored in one of the plurality of storage chambers 184. An amount of tobacco or other smokable substance 500 may be stored in another of the plurality of storage chambers 184. Further, a pack of matches or a lighter 510 may be conveniently stored in yet another of the plurality of storage units 184, such as is shown by way of example in the illustrative embodiment of FIG. 8.

A storage assembly 180 in one embodiment, and more in particular, a storage unit 182 includes a bottle interconnect 186, and a liquid retaining bottle 110 includes a cooperatively configured storage unit interconnect 188 to facilitate secure yet removable attachment of the storage unit 182 to a portion of the liquid retaining bottle 110. With reference again to the illustrative embodiment of FIG. 8, the bottle interconnect 186 comprises a plurality of external threads around an upper portion of the storage unit 182, and the storage unit interconnect 188 of the liquid retaining bottle 110 includes a corresponding plurality of internal threads dimensioned and configured to receive the external threads of the bottle interconnect 186 therein, thereby providing for a secure yet removable attachment of the storage unit 182 to a portion of the liquid retaining bottle 110. It is to be appreciated that a bottle interconnect 186 and storage unit interconnect 188 may comprise any of a number of other cooperatively configured fastening mechanisms including tongue and groove connections, friction fit connections, etc., just to name a few.

In at least one further embodiment, a storage assembly 180 in accordance with the present invention may incorporate one or more ancillary devices such as, by way of example only, an LED light or LED lighting array, an audio speaker or speakers, BLUETOOTH® connectivity, and/or a USB charger, just to name a few.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A multi-use bottle assembly, comprising:

a liquid retaining bottle comprising:

a bulb defining an interior chamber, a primary stem extending outwardly from said bulb and terminating in an open mouthpiece, wherein a first opening located at the open mouthpiece is arranged in fluid communication with the interior chamber of the bulb through a primary through bore formed through the primary stem, the open mouthpiece further comprising a first thread, a second opening formed in the bulb and in fluid communication with the interior chamber of the bulb, the second opening comprising a second thread;

a smoke tube assembly comprising a secondary stem and a bowl connected to the secondary stem, the secondary stem comprising a secondary through bore extending therethrough, the bowl defining a burning chamber therein in fluid communication with the secondary through bore and configured to receive a combustible material;

first and second caps, disconnectably threadable onto the first and second threads to sealingly close the first and second openings, respectively; and a storage assembly comprising a storage unit mountable to a portion of said liquid retaining bottle; wherein the multi-use bottle assembly is selectively positionable in:

a first configuration, in which the first and second caps are disconnected from the first and second threads, respectively, and the smoke tube assembly is inserted into the interior chamber of the bulb with the secondary through bore extending at least partially into the interior chamber of the bulb, and the burning chamber and the combustible material contained therewithin are accessible from outside the bulb and are disposed in fluid communication with the interior chamber of the bulb through the secondary through bore, and a second configuration, in which the smoke tube assembly is removed from the bulb and stored in the storage unit, and the first and second caps are disconnectably threaded to the first and second threads thereby closing the first and second openings, respectively, and enclosing the interior chamber of the bulb; wherein the smoke tube assembly is removable from the interior chamber of the bulb through the second opening to switch from the first configuration to the second configuration.

2. The multi-use bottle assembler as recited in claim 1, wherein said storage unit comprises at least one storage chamber.

3. The multi-use bottle assembly as recited in claim 1, wherein said storage unit comprises a plurality of storage chambers.

4. The multi-use bottle assembly as recited in claim 1, wherein said storage unit is removably mountable to said liquid retaining bottle.

5. The multi-use bottle assembly as recited in claim 1, wherein said liquid retaining bottle is at least partially formed of a glass material.

6. The multi-use bottle assembly as recited in claim 1, wherein said liquid retaining bottle is at least partially formed of a ceramic material.

7. The multi-use bottle assembly as recited in claim 1, wherein said liquid retaining bottle is at least partially formed of a polymeric material.

8. The multi-use bottle assembly as recited in claim 1, wherein the bulb comprises a threaded fitting disposed around said second opening, said threaded fitting defining a through bore disposed in fluid communication with said interior chamber of said hollow bulb, said threaded fitting providing the second thread, and further wherein the secondary stem extends through the through bore of said threaded fitting in the first configuration of the multi-use bottle assembly.

9. The multi-use bottle assembly as recited in claim 8, wherein said bowl is dimensioned and configured to prevent passage into or through said through bore of said threaded fitting in the first configuration, thereby preventing said secondary stem to which said bowl is connected from passing completely through said though bore of said threaded fitting and into said interior chamber of said hollow bulb when the multi-use bottle assembly is arranged in the first configuration.

10. The multi-use bottle assembly as recited in claim 9, wherein, in the first configuration of the multi-use bottle assembly, the bowl of the smoke tube assembly is seated in the threaded fitting.

11. The multi-use bottle assembly as recited in claim 10, wherein said bowl includes an enlarged flange having a diameter greater than said through bore of said threaded fitting such that, when the multi-use bottle assembly is arranged in the first configuration, said enlarged flange seats in said threaded fitting without passing therethrough.

12. The multi-use bottle assembly as recited in claim 10, wherein, with the multi-use bottle assembly arranged in the first configuration, the second cap is disconnectably threadable onto the second thread into a covering and sealing relation to said threaded fitting and said bowl and thereby retaining said smoke tube assembly in position.

* * * * *